US006634623B2

(12) United States Patent
Torres

(10) Patent No.: US 6,634,623 B2
(45) Date of Patent: Oct. 21, 2003

(54) NOTCHED PRIVACY SLAT FOR CHAIN LINK FENCE

(76) Inventor: Ralph Torres, 2357 S. Orange Ave., Fresno, CA (US) 93725

( * ) Notice: Subject to any disclaimer, the term of this patent is extended or adjusted under 35 U.S.C. 154(b) by 0 days.

(21) Appl. No.: 09/791,253

(22) Filed: Feb. 22, 2001

(65) Prior Publication Data

US 2002/0113232 A1 Aug. 22, 2002

(51) Int. Cl.[7] ..... B21F 27/00
(52) U.S. Cl. ..... 256/34
(58) Field of Search ..... 256/24, 27, 34, 256/73

(56) References Cited

U.S. PATENT DOCUMENTS

| | | | | |
|---|---|---|---|---|
| 338,818 | A | | 3/1886 | Baird |
| 2,760,759 | A | | 8/1956 | Rice |
| 2,802,645 | A | | 8/1957 | Rice |
| 2,892,647 | A | | 6/1959 | O'Neill |
| 2,954,964 | A | | 10/1960 | Haffey |
| 3,069,142 | A | | 12/1962 | Kessler |
| 3,227,423 | A | | 1/1966 | DeMatteo |
| 3,285,577 | A | | 11/1966 | Pinson |
| 3,355,150 | A | | 11/1967 | Taylor |
| 3,356,343 | A | | 12/1967 | Taylor |
| 3,572,640 | A | | 3/1971 | Vecchiarelli |
| 3,712,590 | A | | 1/1973 | Torchner et al. |
| 3,958,794 | A | | 5/1976 | Suprunuk et al. |
| 4,343,567 | A | | 8/1982 | Sarver et al. |
| 4,570,906 | A | | 2/1986 | Walden |
| 4,582,284 | A | | 4/1986 | Veenstra |
| 4,723,761 | A | | 2/1988 | Cluff |
| 4,860,998 | A | | 8/1989 | Snyder |
| 4,950,098 | A | | 8/1990 | Abbott et al. |
| 4,995,591 | A | | 2/1991 | Humphrey et al. |
| 5,007,619 | A | | 4/1991 | Sibeni |
| 5,106,058 | A | | 4/1992 | Finkelstein |
| 5,165,664 | A | | 11/1992 | Cluff |
| 5,184,801 | A | | 2/1993 | Finkelstein |
| 5,275,380 | A | | 1/1994 | Barsby |
| 5,395,092 | A | * | 3/1995 | McLaughlan et al. ..... 256/32 |
| 5,458,319 | A | | 10/1995 | Mackay |
| 5,465,941 | A | | 11/1995 | Abbott |
| 5,482,256 | A | | 1/1996 | Caron |
| RE35,208 | E | | 4/1996 | Finkelstein |
| 5,584,468 | A | | 12/1996 | Meglino et al. |
| 5,687,957 | A | | 11/1997 | Finkelstein |
| 5,775,676 | A | | 7/1998 | Hoggan |
| 5,806,839 | A | | 9/1998 | Meglino |
| 5,899,442 | A | | 5/1999 | Meglino et al. |
| 6,068,243 | A | | 5/2000 | Hoggan |
| 6,164,628 | A | * | 12/2000 | Hoggan ..... 256/32 |
| 6,182,947 | B1 | * | 2/2001 | Meglino ..... 256/32 |

* cited by examiner

*Primary Examiner*—Gary S. Hartmann
(74) *Attorney, Agent, or Firm*—Mark D. Miller

(57) ABSTRACT

Disclosed is a privacy slat for insertion into the channels of a chain link fence that engages the knuckles of the fence wire by providing an elongated body member having a pair of longitudinal fins along the outside edges thereof in which at least one notch is provided in at least one of the fins for engagement with a knuckle of the fence. The fence slats of the present invention also utilize a pair of longitudinal fins having a unique angled configuration that substantially fills the fence channel.

13 Claims, 6 Drawing Sheets

NOTCHED PRIVACY SLAT FOR CHAIN LINK FENCE

BACKGROUND OF THE INVENTION

1. Field of the Invention

The present invention relates to privacy slats for chain link fences, and in particular to a unique notched slat for locking engagement with a chain link fence to provide superior privacy and durability.

2. Description of the Prior Art

Traditional chain link fences are made of interwoven wires which link together to form diamond-shaped openings surrounded by the knuckles of the linking wires. Vertical and angled channels are also formed by the wires. Several different varieties of slats have been developed for insertion into the channels formed by chain link fences to obscure the view through the fence and provide a level of privacy. The most significant problem with privacy slats for chain link fences is holding them securely in place in the vertical or angled channels of the fence. Another significant problem is providing the best possible coverage of the vertical channels to maximize privacy and avoid unnecessarily large gaps between slats.

A number of existing chain link fence slats provide an elongated hollow body member having longitudinal fins (or wings or legs) along both outside edges, such as those disclosed in U.S. Pat. Nos. 5,007,619 and 5,184,801. The body member fills the vertical channel and the edge fins engage the knuckles of the wire fence. The '619 patent describes an additional bottom member having a channel into which each of the fence slats may be locked. To further facilitate engagement with the knuckles, many existing fence slats include strands (or fringes or cuts) along the outside edges of the fins, such as those disclosed in U.S. Pat. Nos. 4,687,957; 4,860,998; and 5,775,676. While these inventions provide improved engagement with the fence, they can be difficult to thread into the vertical fence channels, and may still suffer from slippage and movement in the channels. The addition of the bottom locking member is costly, cumbersome and may be prone to failure.

It is therefore desirable to provide a simple easily inserted chain link fence privacy slat that securely engages the fence without the need for additional locking members.

SUMMARY OF THE INVENTION

The present invention provides a chain link privacy slat that is easily inserted into the vertical or angled channels of the fence and which securely engages the knuckles of the fence wire by providing an elongated body member having a pair of longitudinal fins along the outside edges thereof wherein at least one notch is provided in at least one of said fins for engaging a knuckle of the fence. The body member may be solid or hollow, and the fins are provided on opposite sides thereof such that they come into contact with the knuckles of the fence along the vertical channel. A plurality of slats may be provided in parallel positions, each having one or more notches in the same location for engagement with the same corresponding knuckle(s) of each fence channel. Up to three notches may be provided on the fin on one side of the body member near the trailing end. In an alternative embodiment, another notch may be provided on the opposite fin for engagement with a knuckle on the opposite side of the vertical channel. In other alternative embodiments, a plurality of notches may be provided on the fins on one or both sides of the body member; however, too many notches will make it difficult to thread the fence slat into the channel. Fringes or strands may also be provided on the longitudinal fins along with the notch(es).

It is desirable that each of the oppositely positioned fins of each slat provide maximum privacy protection. In the present invention, the hollow or solid body member has a roughly rectangular cross sectional area including a width and depth that fills a large central portion of the elongated chain link fence channel, the two oppositely positioned longitudinal edge fins extending out from the body member to the edges of the channel. The edge fins of the present invention are straight and originate from each of the shorter parallel sides of the body member. These fins may originate at (a) opposite corners of the body member where the shorter parallel sides meet the longer parallel front or back surfaces of the body member, or (b) at opposite positions near the center of each of the shorter parallel sides. Each fin extends outwardly at an acute angle relative to the adjacent shorter side of the body member and each fin is wide enough to reach the center of the wire fence knuckles along the sides of the channel. Each fin extends at the same angle until it reaches the plane of either the front or back surface of the body member, the fin on one side extending until it reaches the plane of the front surface of the body member, the fin on the opposite side extending at the same angle in the opposite direction until it reaches the plane of the back surface of the body member. This configuration provides maximum coverage between slats in the fence when each slat is inserted with its fins extending in the same direction as the fins of all other slats.

In the preferred embodiment, between one and three notches are provided on the same fin on one side of the body member, relatively close to the trailing end of the slat. In this way, most of the slat may be smoothly threaded into the channel of the fence ahead of the notch(es). Each of the notches (or notch) then engages one of the first knuckles (the first knuckle) that it comes into contact with.

In the embodiment having notches on oppositely positioned fins, it is preferable that they be staggered from each other such that the notch on one side engages a knuckle on a different level (row) than the notch on the opposite side. This prevents the formation of large gaps around the knuckles of a single given row.

It is therefore a primary object of the present invention to provide a privacy slat for a chain link fence that securely engages the fence.

It is also a primary object of the present invention to maximize the coverage provided by privacy slats for chain link fences.

It is also an important object of the present invention to provide a privacy slat for a chain link fence having an elongated central body member and a pair of oppositely positioned outwardly extending fins with one of said fins having at least one notch therein for engaging a knuckle of the chain link fence.

It is also an important object of the present invention to provide a privacy slat for a chain link fence having an elongated central body member and a pair of oppositely positioned outwardly extending fins which extend outwardly at acute angles from opposite sides or corners of the body member.

Additional objects of the invention will be apparent from the detailed descriptions and the claims herein.

DETAILED DESCRIPTION OF THE PREFERRED EMBODIMENT

Figure 1:
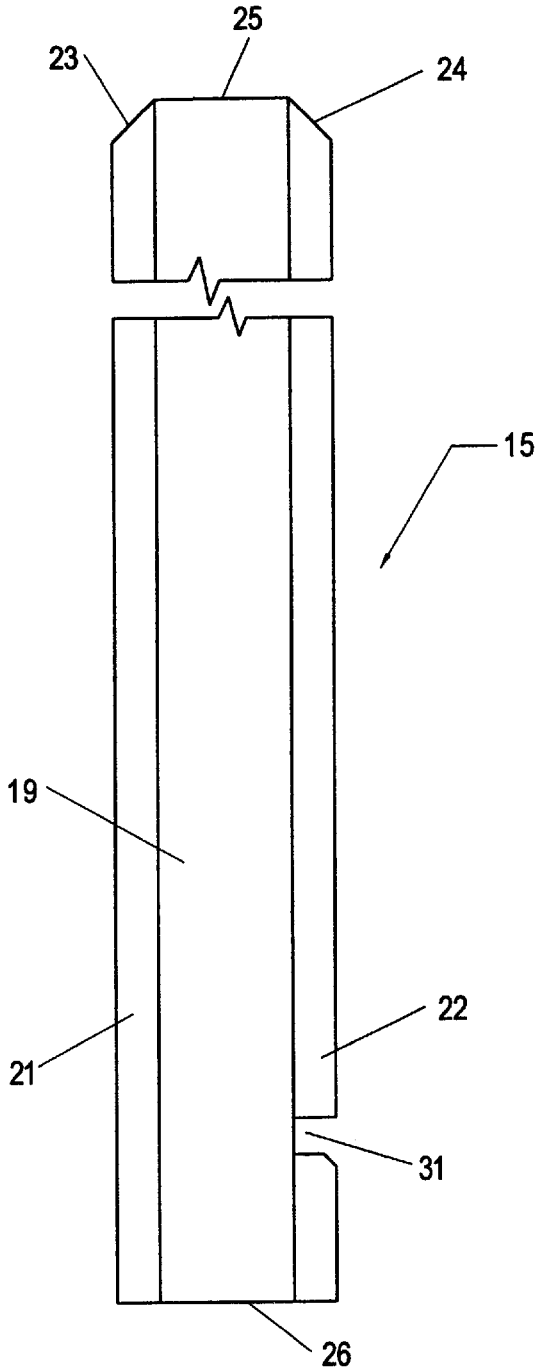
FIG. 1 is a side view of the present invention showing a single notch in a fin.
Figure 2:
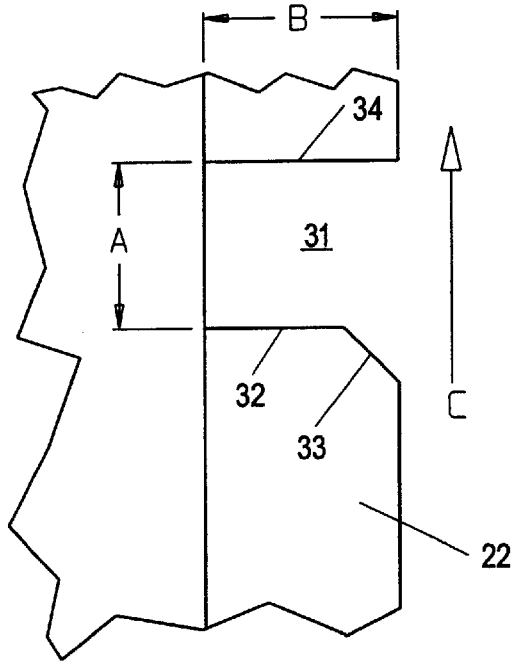
FIG. 2 is an enlarged view of the notch of FIG. 1.
Figure 4:
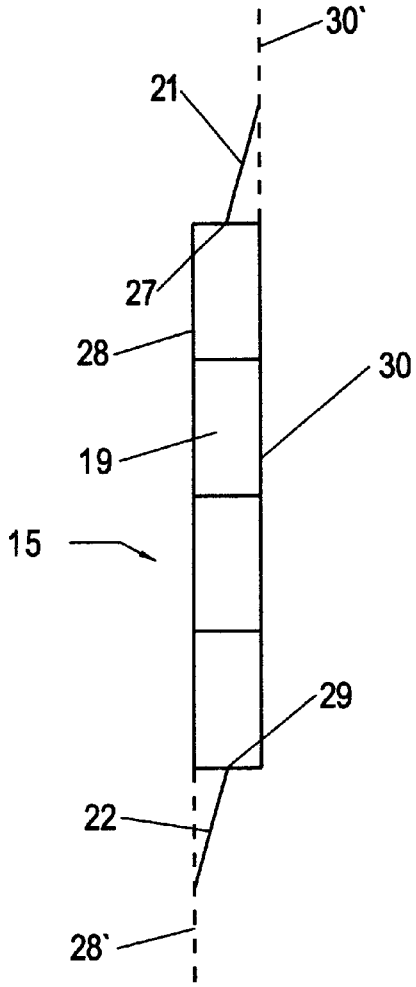
FIG. 4 is a cross-sectional top view of a fence slat of the present invention.

Referring to the drawings wherein like reference characters designate like or corresponding parts throughout the several views, and referring particularly to FIGS. 1 and 4 it is seen that the invention includes a slat generally 15 having an elongated hollow body member 19 having a leading end 25 and a trailing end 26. A pair of longitudinal fins 21 and 22 are provided on opposite sides of body member 19 extending along the length thereof. Body member 19 is designed to fill the open central area of a vertical or angled channel of a chain link fence, with fins 21 and 22 extending out from body member 19 to the centers of the knuckles 45 formed by the wires 42 of the fence. Angular cuts 23 and 24 are provided in fins 21 and 22, respectively, at the leading end 25 of body member 19 to facilitate insertion of member 19 into the channels of the chain link fence.

Figure 8:
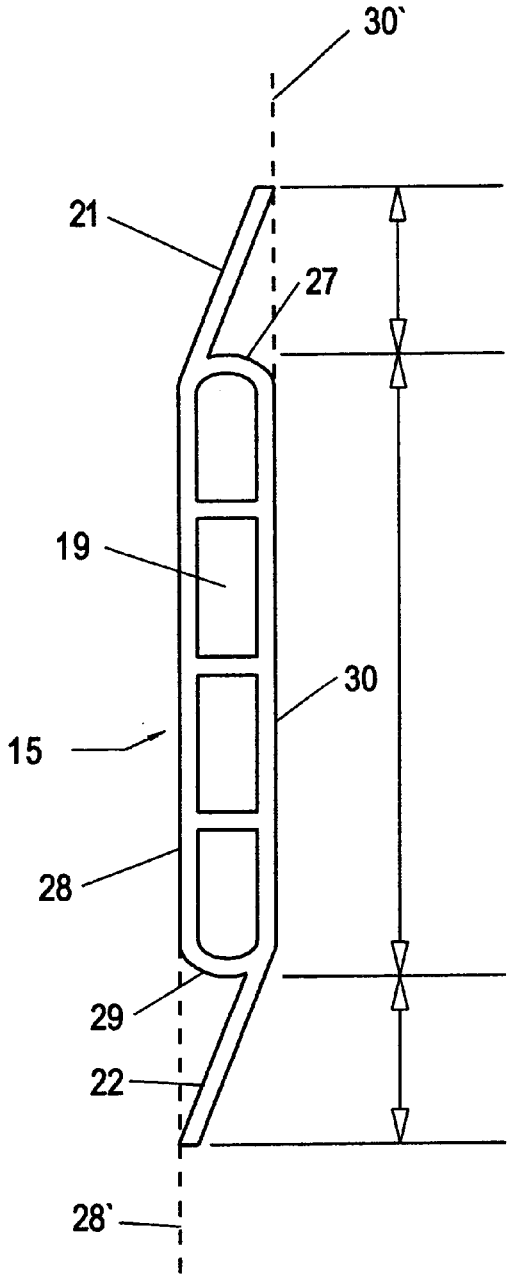
FIG. 8 is a cross-sectional top view of another embodiment of the fence slat of the present invention.

Body member 19 has a generally rectangular cross section as shown in FIG. 4, and may be solid or hollow. In the hollow embodiment shown in FIG. 4, or in a solid embodiment, body member 19 has a front surface 28, a parallel rear surface 30, and two shorter connecting parallel opposite sides 27 and 29. Fins 21 and 22 extend out from the sides 27 and 29 of body member 19, originating at opposite positions thereon Fins 21 and 22 may originate near the centers of sides 27 and 29 as shown in FIG. 4, or from the comers as shown in FIG. 8. Each of fins 21 and 22 extends out at an acute angle relative to its respective side (27 or 29) a sufficient distance to reach the plane of the opposite surface of body member 19. Each of fins 21 and 22 is also wide enough to fill the fence channel (i.e. to reach the centers of the wire fence knuckles 45).

In particular, in FIG. 4, fin 21 extends at an acute angle relative to side 27 beginning at a position on side 27 and ending to a location on the plane 30' of rear surface 30. Similarly, fin 22 extends at an acute angle relative to side 29 beginning at an opposite position on side 29 and ending to a location on the plane 28' of front surface 28. In FIG. 8, fin 21 originates at the corner of surface 28 and side 27 of body member 19 and extends at an acute angle relative to side 27 beginning at the corner and ending when it reaches plane 30' of rear surface 30. Similarly, 22 originates at the corner of surface 30 and side 29 of body member 19 and extends at an acute angle relative to side 29 beginning at said corner and ending when it reaches plane 28' of front surface 28. Maximum privacy is provided by installation of identical adjacent fence slats 15 having fins 21 and 22 with the same configuration, the fins of each adjacent slat having the same position as the fins of all other slats.

At least one notch 31 is provided on one of fins 21 or 22, as shown in the preferred embodiments of FIG. 1. In this embodiment, a single notch 31 is cut into fin 22 near the trailing edge 26 of slat 15 in order to facilitate easy insertion of slat 15 into the chain link fence channel in the direction of arrow C. Notch 31 has a length A and a depth B, and includes an angular cut 33 on its trailing edge 32. Cut 33 on the trailing edge 32 of notch 31 makes it easier (although still somewhat difficult) to pull slat 15 past a knuckle 45 in fence wires 42 while traveling in direction C; it is much more difficult to pull slat 15 in the opposite direction as no cut is provided on the leading edge 34 of notch 31. Length A and depth B of notch 31 may be of any suitable dimension. In the preferred embodiment, the length dimension A should be approximately twice the depth dimension B.

Figure 3:
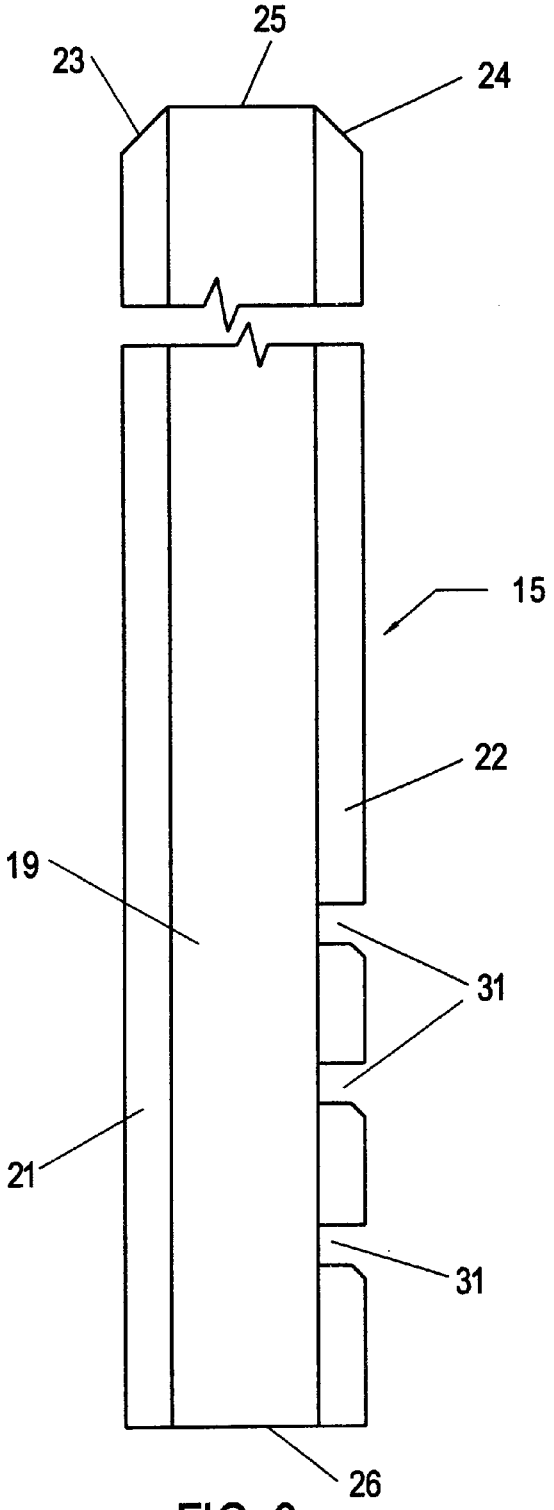
FIG. 3 is a side view of another embodiment of the present invention showing three notches on one fin.
Figure 5:
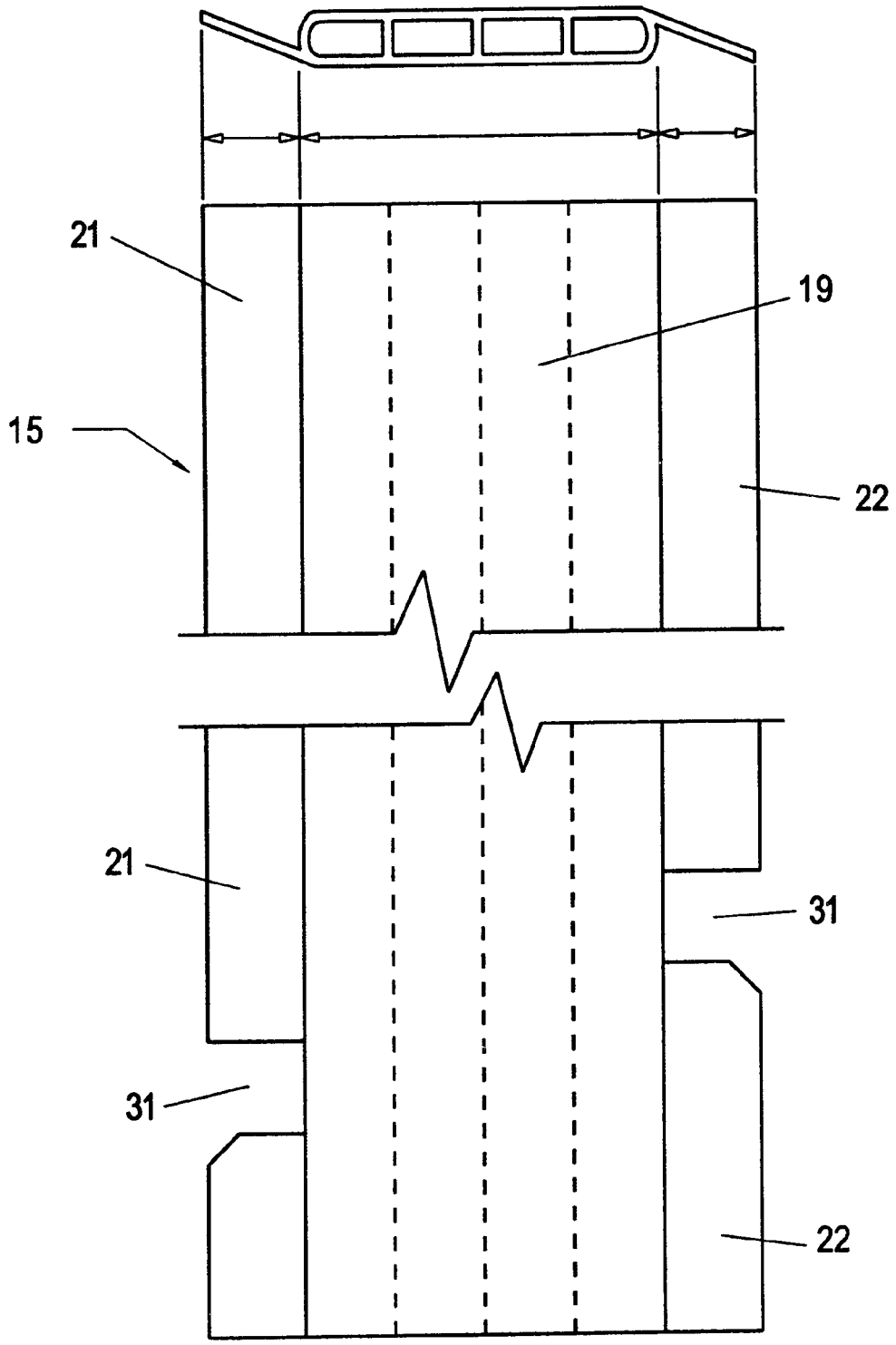
FIG. 5 is a side view of another embodiment of the present invention showing the location of notches on opposite fins relative to the main body of the slat.
Figure 6:
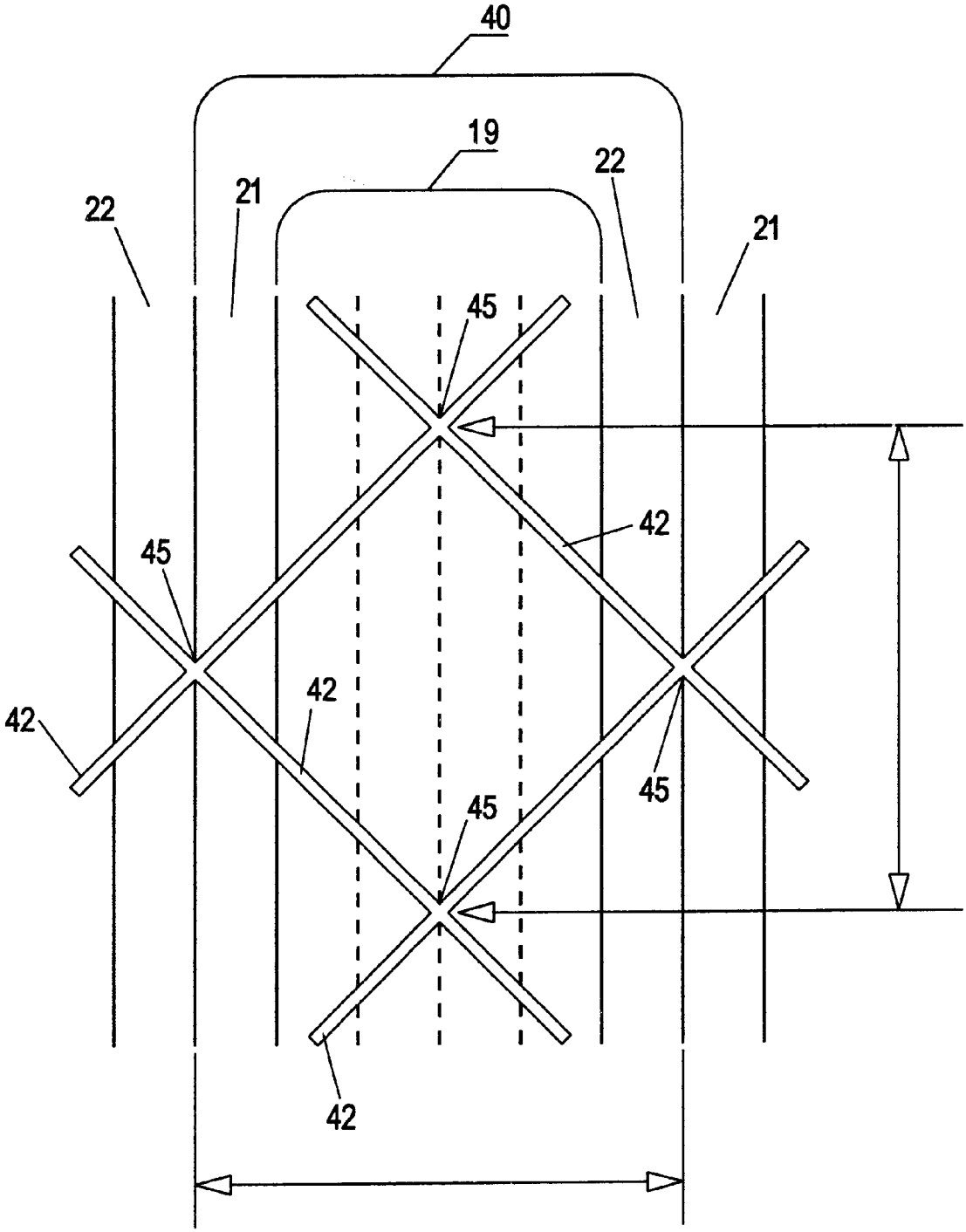
FIG. 6 is a side view of the fence slat of the present invention installed in a chain link fence.
Figure 7:
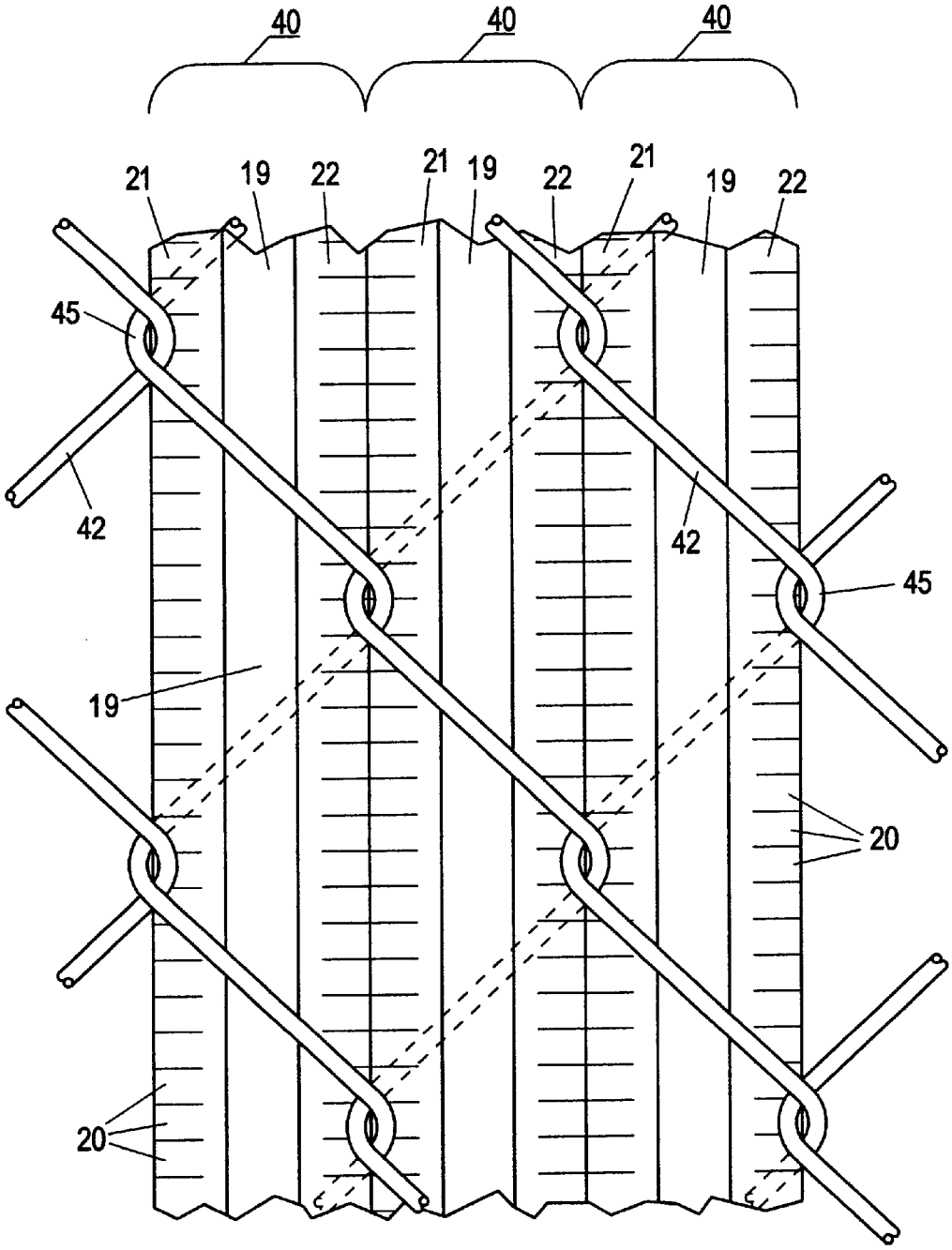
FIG. 7 is a side view of another embodiment of the present invention installed in a chain link fence.

Another preferred embodiment is illustrated in FIG. 3 having three notches 31 on one fin. These notches could be on either fin 21 or 22. Cuts 33 on the uppermost two notches facilitate pulling them past at least two knuckles 45 as slat 15 is inserted into a fence channel 40 with leading edge 25 going first. An alternative embodiment is shown in FIG. 5 having at least one notch 31 on each of opposite fins 21 and 22. The positions of notches 31 in FIG. 5 are staggered because of the staggered positions of knuckles 45 on opposite sides of a chain link fence channel 40 (as illustrated in FIGS. 6 and 7).

Fence slats 15 of the present invention are installed by first locating a vertical or angled channel 40 in a chain link fence. Then, leading edge 25 is inserted into the channel, aided by cuts 23 and 24. The smooth edges of fins 21 and 22 slide past knuckles 45 of the fence channel 40 until the first notch 31 is encountered. Notch 31 locks over the first knuckle 45 that it comes into contact with. Notch 31 may be the only one provided in which case it should be very close to the trailing edge 26 of slat 15 so that once this first knuckle is encountered, the position of slat 15 is fixed. In such a case, no cut 33 is required, and it may be eliminated. However, where additional or multiple notches 31 are provided, slat 15 must be inserted further. Cuts 33 on each of notches 31 facilitates such further movement, allowing slat 15 to be inserted more easily (although with great difficulty) than it can be removed. However, the more notches provided, the more difficult it is to continue insertion of slat 15. It is therefore preferred that no more than three notches 31 be used. It is also very difficult to continue such insertion when notches are provided on both of opposite fins 21 and 22. It is therefore preferred that all notches be located on one or the other of fins 21 or 22, but not on both fins.

In one embodiment, a set of fringes, fingers or strands 20 may be provided along the lengths of fins 21 and 22 in order to allow the fins to more closely conform to the shape of the fence channels, and to slide between knuckles 45 during insertion.

It is to be appreciated that any number of notches 31 may be provided on one or both of fins 21 and 22. When more than one notch 31 is used, the leading notches may have a lesser depth dimension B, and may have a larger or more acutely angled cut 33 in order to facilitate pulling such leading notches through the fence channel 40. Cut 33 may be eliminated from the lowermost of notches 31 to prevent movement in either direction once such notch locks over a fence knuckle 45.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

What is claimed is:

1. A privacy slat inserted into a channel formed between forward and rearward wires of a chain link fence comprising an elongated body member, first and second fins extending out from opposite sides of said body member for engagement with the edges of said channel, and at least one notch in one of said fins for locking engagement with a knuckle formed by the linking of the wires of said fence.

2. The privacy slat of claim 1 wherein said at least one notch has a leading and trailing edge and a length and a depth, wherein the length is approximately twice the depth, and wherein an angular cut is provided on said trailing edge.

3. The privacy slat of claim 1 wherein a pair of notches is provided in one of said fins.

4. The privacy slat of claim 1 wherein each fin has substantially the same width and extends out from said body member in order to fill the width of said channel, and a first notch is provided in said first fin, and a second notch is provided in said second fin.

5. A privacy slat for use with a chain link fence comprising an elongated body member, first and second fins extending from said body member in opposite directions for engagement with the edges of a channel formed by the wires of the fence, and at least one notch in one of said fins for locking engagement with a knuckle formed by the linking of the wires of said fence wherein said body member has a front surface, a rear surface, and parallel opposite sides, and each of said fins is attached at an acute angle to one of said opposite sides of said body member, and wherein each such fin has substantially the same width and extends straight out from said body member in order to fill the width of said channel.

6. An arrangement of slat members for use with a fence of the type having linking wires which form knuckles and define a plurality of slat receiving channels between forward and rearward wires the arrangement comprising a plurality of slat members inserted into said channels, each of said slat members including an elongated body member, first and second fins extending out from opposite sides of said body member for engagement with the edges of said channel, and at least one fin of each slat member having at least one notch therein for locking engagement with one of said knuckles.

7. The arrangement of claim 6 wherein each fin of each slat member has substantially the same width, and said at least one notch has a leading and trailing edge and a length and a depth, wherein the length is approximately twice the depth, and wherein an angular cut is provided on said trailing edge.

8. A privacy slat for use with a chain link fence comprising an elongated body member, first and second fins extending from said body member in opposite directions for engagement with the edges of a channel formed by the wires of the fence, and at least one notch in one of said fins for locking engagement with a knuckle formed by the linking of the wires of said fence wherein said body member has a front surface, a rear surface, and parallel opposite sides, and each of said fins is attached at an acute angle to one of said opposite sides of said body member, and wherein each such fin has substantially the same width and extends straight out from said body member in order to fill the width of said channel.

9. A slat for insertion in a channel of a chain link fence, the channel being defined by proximal and distal portions of wire mesh fencing fabric of the chain link fence and on opposite sides by a plurality of intermittently spaced, opposing knuckles defined at intersections of the wire mesh fencing fabric, the opposing knuckles defining a width of the channel, said slat comprising an elongated body member having a front surface, an opposing rear surface, and connecting opposite parallel sides, first and second fins, each such fin being attached at an acute angle to one of the opposite sides of said body member, each such fin having substantially the same width and extending out from said body member in order to fill the width of said channel, and at least one notch in one of said fins for locking engagement with one of said knuckles.

10. The slat of claim 9 wherein said at least one notch has a leading and trailing edge and a length and a depth, wherein the length is approximately twice the depth, and wherein an angular cut is provided on said trailing edge.

11. A privacy slat inserted into a channel of a fence of the type having linking wires which form knuckles and define a plurality of slat receiving channels between forward and rearward wires said slat comprising an elongated body member having opposing sides and opposing end portions, a pair of flexible and resilient fin portions of substantially the same width, each fin portion extending from each of said end portions of said elongated body member, wherein outer ends of said fin portions are sufficiently thin so as to enable said fin portions to flex around the fence knuckles and extend beyond said slat receiving channels such that substantially no space remains between the fin portions of adjacent slat members when positioned in the slat receiving channels of the fence wherein at least one notch is provided in one of said fins for locking engagement with one of said knuckles.

12. A privacy slat for insertion in a channel of a fence of the type having linking wires which form knuckles and define a plurality of slat receiving channels therebetween said slat comprising an elongated body member having opposing sides and opposing end portions, a pair of flexible and resilient fm portions of substantially the same width, each fin portion extending from each of said end portions of said elongated body member, wherein outer ends of said fin portions are sufficiently thin so as to enable said fin portions to flex around the fence knuckles and extend beyond said slat receiving channels such that substantially no space remains between the fin portions of adjacent slat members when positioned in the slat receiving channels of the fence wherein at least one notch is provided in one of said fins for locking engagement with one of said knuckles, wherein said at least one notch has a leading and trailing edge and a length and a depth, wherein the length is approximately twice the depth, and wherein an angular cut is provided on said trailing edge.

13. A privacy slat for insertion in a channel of a fence of the type having linking wires which form knuckles and define a plurality of slat receiving channels therebetween said slat comprising an elongated body member having opposing sides and opposing end portions, a pair of flexible and resilient fin portions of substantially the same width, each fin portion extending from each of said end portions of said elongated body member, wherein outer ends of said fin portions are sufficiently thin so as to enable said fin portions to flex around the fence knuckles and extend beyond said slat receiving channels such that substantially no space remains between the fin portions of adjacent slat members when positioned in the slat receiving channels of the fence wherein at least one notch is provided in one of said fins for locking engagement with one of said knuckles, wherein each of said fins is attached at an acute angle to one of said end portions of said body member, and wherein each such fin has substantially the same width and extends directly out from said body member in order to fill the width of said channel.

* * * * *